US008279089B2

(12) United States Patent
Nally et al.

(10) Patent No.: US 8,279,089 B2
(45) Date of Patent: Oct. 2, 2012

(54) METHOD AND DEVICE FOR MONITORING THE FUNCTION OF A SAFETY UNIT

(75) Inventors: James M. Nally, Holland, OH (US); Mark Wise, Lake Zurich, IL (US); Robert Lass, Mundelein, IL (US)

(73) Assignee: Ellenberger & Poensgen GmbH, Altdorf (DE)

( * ) Notice: Subject to any disclaimer, the term of this patent is extended or adjusted under 35 U.S.C. 154(b) by 454 days.

(21) Appl. No.: 12/563,397

(22) Filed: Sep. 21, 2009

(65) Prior Publication Data

US 2010/0123603 A1 May 20, 2010

Related U.S. Application Data

(60) Provisional application No. 61/116,476, filed on Nov. 20, 2008.

(51) Int. Cl.
*G08B 23/00* (2006.01)

(52) U.S. Cl. ..... 340/984; 340/603; 340/628

(58) Field of Classification Search ..... 340/984, 340/603, 632, 618, 620, 540, 657, 664, 627–628
See application file for complete search history.

(56) References Cited

U.S. PATENT DOCUMENTS

| | | | | |
|---|---|---|---|---|
| 4,207,146 | A * | 6/1980 | Kunke | 205/782.5 |
| 4,897,822 | A * | 1/1990 | Korten et al. | 367/124 |
| 5,169,348 | A * | 12/1992 | Ogiwara et al. | 440/1 |
| 5,404,048 | A * | 4/1995 | Panner | 307/118 |
| 6,005,483 | A * | 12/1999 | West | 340/618 |
| 6,526,954 | B1 * | 3/2003 | Baranzahi et al. | 123/673 |

* cited by examiner

*Primary Examiner* — Daniel Previl
(74) *Attorney, Agent, or Firm* — Laurence A. Greenberg; Werner H. Stemer; Ralph E. Locher

(57) ABSTRACT

A method for monitoring a function of a safety unit, in particular of a bilge blower of a boat with a combustion engine, connected via a manually operated switch to a voltage supply. The current flowing through the safety unit is measured and an acoustic alarm is triggered, if a sensor voltage derived from the measured current falls below a reference voltage.

20 Claims, 3 Drawing Sheets

METHOD AND DEVICE FOR MONITORING THE FUNCTION OF A SAFETY UNIT

CROSS-REFERENCE TO RELATED APPLICATION

This application claims the priority, under 35 U.S.C. §119 (e), of provisional application No. 61/116,476, filed Nov. 20, 2008; the prior application is herewith incorporated by reference in its entirety.

BACKGROUND OF THE INVENTION

Field of the Invention

The invention relates to a method for monitoring the function of a safety unit connected to a voltage supply, in particular to a 12V or 24V battery.

The invention specifically relates to a monitoring system for an electrical circuit, in particular of a DC electrical circuit in vehicles, in particular in a motorized sail boat having a combustion engine, the monitoring method relating substantially to two conditions which could occur in safety units operated by a corresponding switching circuit. One of these conditions is an incomplete or interrupted switching circuit between the enabling switch and ground. The other condition is a situation in which a safety unit not needed at the moment is, nevertheless, operated, for example due to inattentiveness of the operator or because the latter does not notice the operation of the safety unit. In both cases described, it is desirable to draw the attention of the operator to this situation, in particular by an appropriate alarm.

A preferred safety unit of the monitoring system according to the invention is the bilge blower of a boat driven by a combustion engine (inboard engine) operated with a volatile fuel, such as, for example, gasoline or diesel. The combustion engine is usually arranged in the so-called bilge in the stern area of the boat, for example of a sporting boat. By bilge, one understands the lowermost hull of a ship, situated directly above the planks or above the keel.

Due to the arrangement of the engine in the bilge, it is practically inevitable that combustible gases escape from the engine and fuel-tank system. These gases could accumulate, forming an explosive mixture, which in turn involves the danger that, upon starting the combustion engine, due to a spark discharge or due to the commutator sparking of an electric motor used as the starter, the explosive mixture ignites and the boat is destroyed.

Due to this situation of danger, such boats with an inboard engine include at least one bilge blower as a safety unit. The blower, which is expediently also arranged in the bilge, i.e. in the engine room, is usually operated by an electrical circuit, which in turn is connected with the on-board battery (battery of the starter or of the on-board network) of usually $12V_{DC}$ or $24_{DC}$.

A provision of the United States Coast Regulation and other directives concerning the operating method and the operational conditions of such bilge blowers provide that these bilge blowers must have been in operation for at least 4 minutes before the combustion engine can be started. This period is meant for removing the combustible gas mixture out of the bilge, i.e. out of the engine room and for aerating the latter, so that no more explosive gas mixture will be present in it. Further directives or recommendations concern the function of these blowers, for example the fact that they can also be in operation while the combustion engine is running idling or with very little power, or while the boat is running at a very low speed.

Even though such directives recommend operating these blowers continuously during the use of the boat, such a continuous operation is neither necessary nor economic in view of the unnecessary energy consumption. Therefore, one tries to operate these blowers and safety units only as long as necessary.

Irrespective of whether such safety units, such as, in particular, bilge blowers, are operated continuously or for limited periods only, the harsh environment, in which these safety units are located, involves the danger of undesired interruptions of electrical circuits, contacting errors, or faulty units, with the consequence that the electrical supply circuit is interrupted (open circuit). In the preferred application of the invention on a boat, such faults and interruptions of the electrical circuit are often not recognizable, due to the given environmental conditions. For example, the correct operation of the bilge blower is often not easily audible for the boatsman. Similarly, in glaring sunlight, the position lights or the like prescribed on a boat are not easily and doubtlessly visually recognizable. Furthermore, such acoustic or optical monitorings of the safety unit would require the conscious and perfect attention of the boatsman, which is not necessarily guaranteed.

If, for example, in a concrete application, an enabling switch for the bilge blower has been put into the ON position, it will not be guaranteed that the bilge blower or another safety unit will actually be current-carrying, i.e. supplied with power. The reason for this could be a contacting error, a defective blower motor or another interruption of the electrical supply circuit.

On the other hand, it cannot be excluded that a perfectly functioning safety unit is actually not deactivated by the boatsman or vehicle driver, after this unit has fulfilled its task and is not needed at the moment. In particular, the bilge blower, which is directly connected with the supply battery through the enabling switch or ignition switch of the boat, will be continuously in operation, as long as the blower is not switched off. This situation could lead to a complete emptying of the vehicle or supply battery, which is extremely undesirable. Similar situations arise for other safety units, such as, for example, position lamps, whose functioning should be guaranteed for reasons of safety, whose continuous operation should, however, be avoided, if possible, both for saving energy and for reasons of safety in view of avoiding a complete emptying of the vehicle battery.

SUMMARY OF THE INVENTION

It is accordingly an object of the invention to provide a method and a device for monitoring the function of a safety unit which overcomes the above-mentioned disadvantages of the prior art devices of this general type. The invention is based on the task to provide a method as reliable as possible and a device as simple and cost-advantageous as possible for monitoring the function of such a safety unit, in particular of a bilge blower.

With the foregoing and other objects in view there is provided, in accordance with the invention, a method for monitoring a function of a safety unit connected via a manually operated switch to a voltage supply. The method includes the steps of: measuring a current flowing through the safety unit; and triggering an acoustic alarm, if a sensor voltage derived from the current measured falls below a reference voltage.

According to the invention, upon actuation of the enabling switch into its ON position, first of all, the current flowing between the voltage source, in particular the vehicle battery, and the safety unit, is detected. If no current flow is detected, an acoustic alarm will be triggered. The acoustic alarm signals to the operator that the electrical circuit between the on-board battery and the safety unit is interrupted, so that this unit is not in operation.

For detecting the current, a shunt is particularly suitable. The shunt is a reliable current meter and is, in addition, cost-saving and, therefore, economic. Furthermore, current detection by such a shunt enables the generation of a voltage signal, in the following referred to as a sensor voltage, which through the value of resistance of the shunt is proportional to the measured current.

The detected sensor voltage is preferably first amplified and suitably low-pass filtered in order to filter out high-frequency disturbances, in particular initial current peaks or the like. For this purpose, an operational amplifier, expediently switched as an active low pass, is particularly suited.

For this, the voltage potentials tapped on both sides of the shunt are preferably supplied to the two inputs, i.e. the inverting input and the non-inverting input, of the operational amplifier. If the electrical circuit is interrupted, no current will flow through the shunt, with the consequence that no voltage will drop through the shunt. Therefore, the voltages or voltage values on the two inputs of the operational amplifier are identical, so that no voltage signal can be tapped on its output, or a low level is applied on the output of the operational amplifier, respectively.

If, on the other hand, the electrical circuit of the safety unit is not interrupted, the load current of the safety unit will flow through the shunt and the corresponding voltage drop through the shunt will be detected by the operational amplifier, with the consequence that the latter supplies on its output an amplified voltage signal or a high level, respectively. The voltage level is suitably compared with a reference voltage. If the corresponding (amplified) sensor voltage falls below the reference voltage, which will be the case in particular in case of a low level on the output of the operational amplifier, the acoustic alarm will be triggered. A comparator, to whose inputs the sensor voltage and the reference voltage are supplied, is particularly well suited for this. If the sensor voltage falls below the reference voltage, a corresponding control signal (low or high level) will be generated on the output of the comparator, the signal, in turn, being used for selecting an acoustic alarm-signalling device, for example a piezoelectric alarm-signalling device.

To provide a further functionality, also in the form of an acoustic alarm, for the case that the perfectly operating safety unit is not switched off by the operator, a comparison of the sensor voltage with the reference voltage is also used for activating a timer circuit, if the electrical circuit of the safety unit is not interrupted and the enabling switch is put into its ON position. For this purpose, a further comparator is particularly well suited, whose output will supply a control signal for the timer circuit, when the sensor voltage is equal to, or higher than, the reference voltage. The timer circuit is in that case set, for example, to a time interval of 10 or 15 minutes, after expiry of which the acoustic alarm will be triggered.

The timer circuit is connected on the output side preferably with a pulse generator for selecting the acoustic alarm-signalling device. The pulse generator, in turn, is connected on the output side expediently with a driver circuit for the piezoelectric alarm-signalling device.

The timer function and, thus, the alarm function for monitoring the operating time of the safety unit, can suitably also be deactivated. For this purpose, a hand switch is provided, which is expediently wired into an electrical circuit for the voltage supply of the timer circuit. In the voltage supply for the timer circuit, preferably an electronic switch, in particular a bipolar transistor is also wired. The latter's gate (base) is suitably connected with the output of the comparator selecting the timer circuit.

Another electronic switch, preferably also in the form of a bipolar transistor, is suitably wired into a further electrical circuit of the voltage supply supplying the acoustic alarm-signalling device or the pulse generator connected upstream of the acoustic alarm-signalling device with power separately, i.e. independently of the timer circuit. The gate (base) of this further electronic switch is conducted to the output of the comparator directly connected with the alarm-signalling device or the pulse generator.

The supply voltage is in this case also generated by the vehicle battery, but is subjected before to a voltage limitation, in particular by a Zener diode, and to a linear control for voltage stabilization.

The enabling switch suitably includes a safety fuse and an indicator lamp, the fuse being connected downstream of the vehicle battery, but upstream of the switching contacts properly speaking of the enabling switch. The indicator lamp is connected between the fuse and the switching contacts of the enabling switch and is connected to ground. If the fuse responds and if, thus, the electrical circuit between the on-board battery and the enabling switch is interrupted, no current will flow through the indicator lamp, so that this lamp will not illuminate, even if the enabling switch has been put into ON position. This signals to the boatsman or vehicle driver that there is an interruption in the electrical circuit for the safety unit, which must be located between the on-board battery and the enabling switch, because the indicator lamp has gone out.

Other features which are considered as characteristic for the invention are set forth in the appended claims.

Although the invention is illustrated and described herein as embodied in a method and a device for monitoring the function of a safety unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
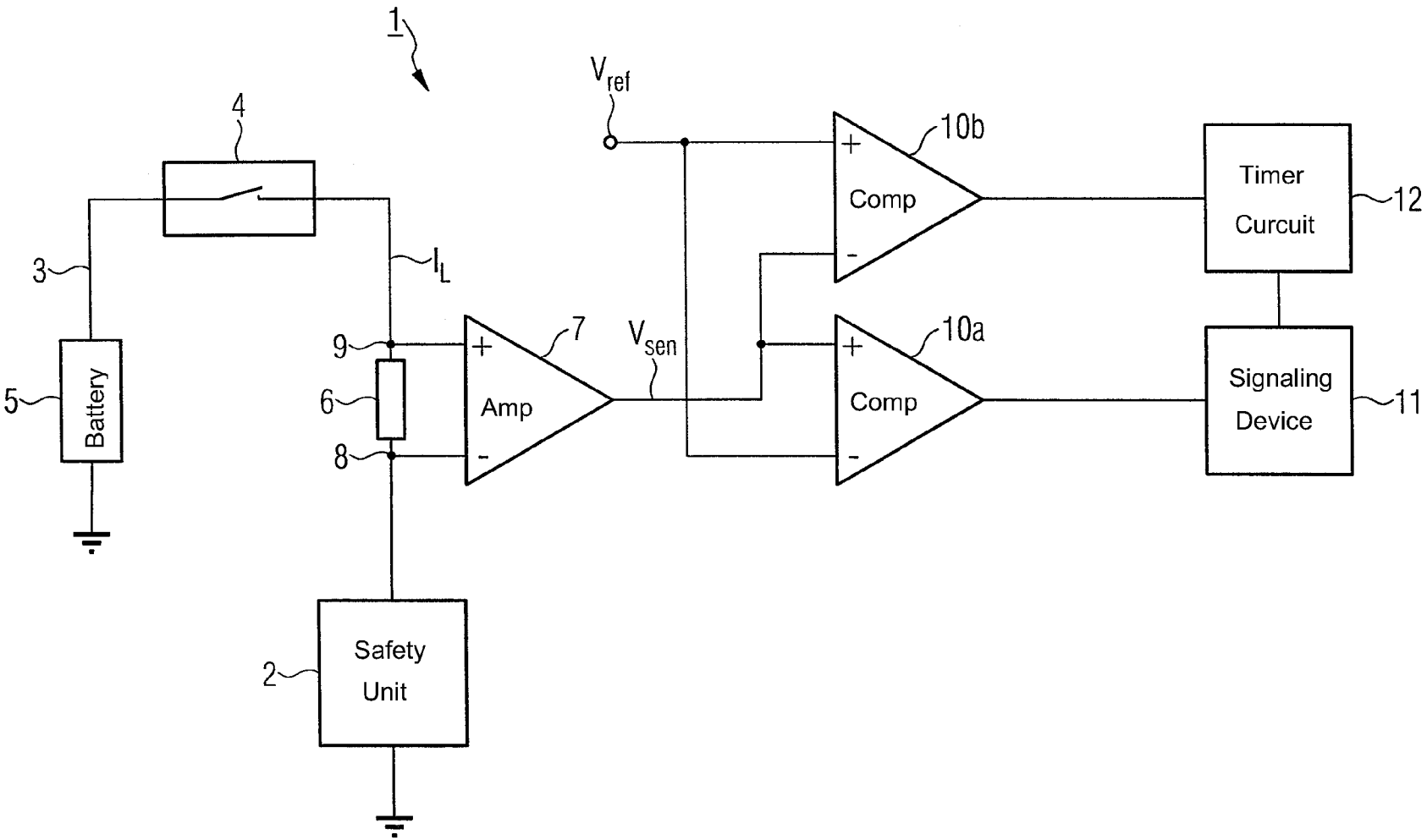
FIG. 1 is a schematic block diagram of a device for monitoring a function of a safety unit according to the invention.

Corresponding parts are marked with the same reference numbers in all figures. Referring now to the figures of the drawing in detail and first, particularly, to FIG. 1 thereof, there is shown a block diagram of an electronic circuit 1 as a device for monitoring the function of a safety unit 2, which in the exemplary embodiment is a bilge blower. The bilge blower 2 is connected, in an electrical circuit 3 to be monitored, via an enabling switch 4 to a vehicle battery (starter or on-board network battery) 5, in particular of a motorboat or sailboat. The negative pole of the battery 5 is connected to ground. Similarly, one connector end of the bilge blower 2 is connected to ground. In the electrical circuit 3 to be monitored, a shunt 6 is connected for measuring the load current $I_L$ flowing through the bilge blower 2. The voltage drop through the shunt 6 is tapped on both sides of the shunt 6 and supplied to an operational amplifier 7. For this purpose, a tap 8 is connected between the shunt 6 and the bilge blower 2 to a non-inverting input (−) of the operational amplifier 7. Analogously, a tap 9 is connected between the shunt 6 and the enabling switch 4 to an inverting input (+) of the operational amplifier 7. The operational amplifier 7 is, for example, a standard amplifier of type μA 741.

The output side of the operational amplifier 7 is connected to two comparators 10*a* and 10*b*, to whose input side, a reference voltage $V_{ref}$ is also supplied. Instead of the two comparators 10*a* and 10*b*, a low-power low-offset voltage dual comparator, for example, of type LM 239, can be provided. The sensor voltage $V_{sen}$ generated by the operational amplifier 7 and tappable on the latter's output side is supplied to the non-inverting input (+) of the first comparator 10*a* as well as to the inverting input (−) of the second comparator 10*b*. Analogously, the reference signal or the reference voltage $V_{ref}$, respectively, is supplied to the inverting input (−) of the first comparator 10*a* as well as to the non-inverting input (+) of the second comparator 10*b*. The output side of the first comparator 10*a* is connected to an acoustic alarm-signalling device 11. The output side of the second comparator 10*b* is connected to a timer circuit 12, whose output side in turn is connected to the acoustic alarm-signalling device 11.

Figure 2:
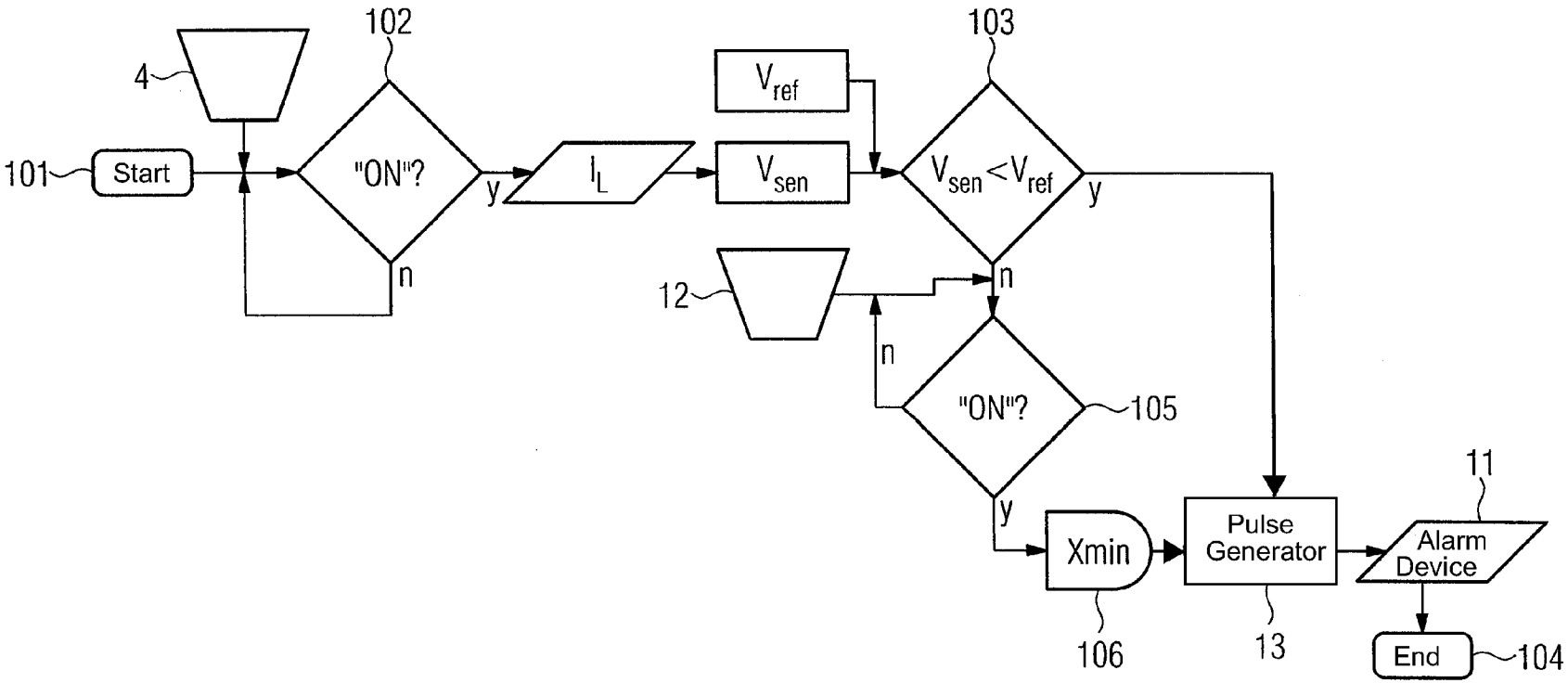
FIG. 2 is a flow chart of the fundamental functionality of the monitoring method according to the invention.

The method according to the invention for monitoring the function of the safety unit in the form of the bilge blower 2 connected, via the manually operated enabling switch 4, to the on-board battery 5 and thus to the voltage supply, is explained in detail with the flow chart represented in FIG. 2. Upon a start 101 of the monitoring function, it is first of all inquired, in a monitoring step 102, whether the enabling switch 4 has been put into ON position. If this is not the case, the enabling switch 4 has to be put into ON position. When the enabling switch is in ON position, the load current ($I_L$) as well as its transformation into the sensor voltage $V_{sen}$ will be measured. For this purpose, the actual load current $I_L$ is detected by the shunt 6 and the voltage drop tappable on the shunt 6 is supplied to the input side of the operational amplifier 7. Then, by the comparators 10*a* and 10*b*, the existing sensor voltage $V_{sen}$, which is amplified in the operational amplifier 7 and, if necessary, low-pass filtered, is compared with the reference voltage $V_{ref}$. According to the flow chart, the inquiry 103 whether the sensor voltage $V_{sen}$ is smaller than the reference voltage $V_{ref}$ is affected in this context. If this is the case, the output side of the first comparator 10*a* supplies a control signal (high-level), thus activating the alarm-signalling device 11, a pulse generator 13, for example, being selected for this purpose, which in turn activates the acoustic alarm-signalling device 11 and terminates the monitoring method 104.

Figure 3:
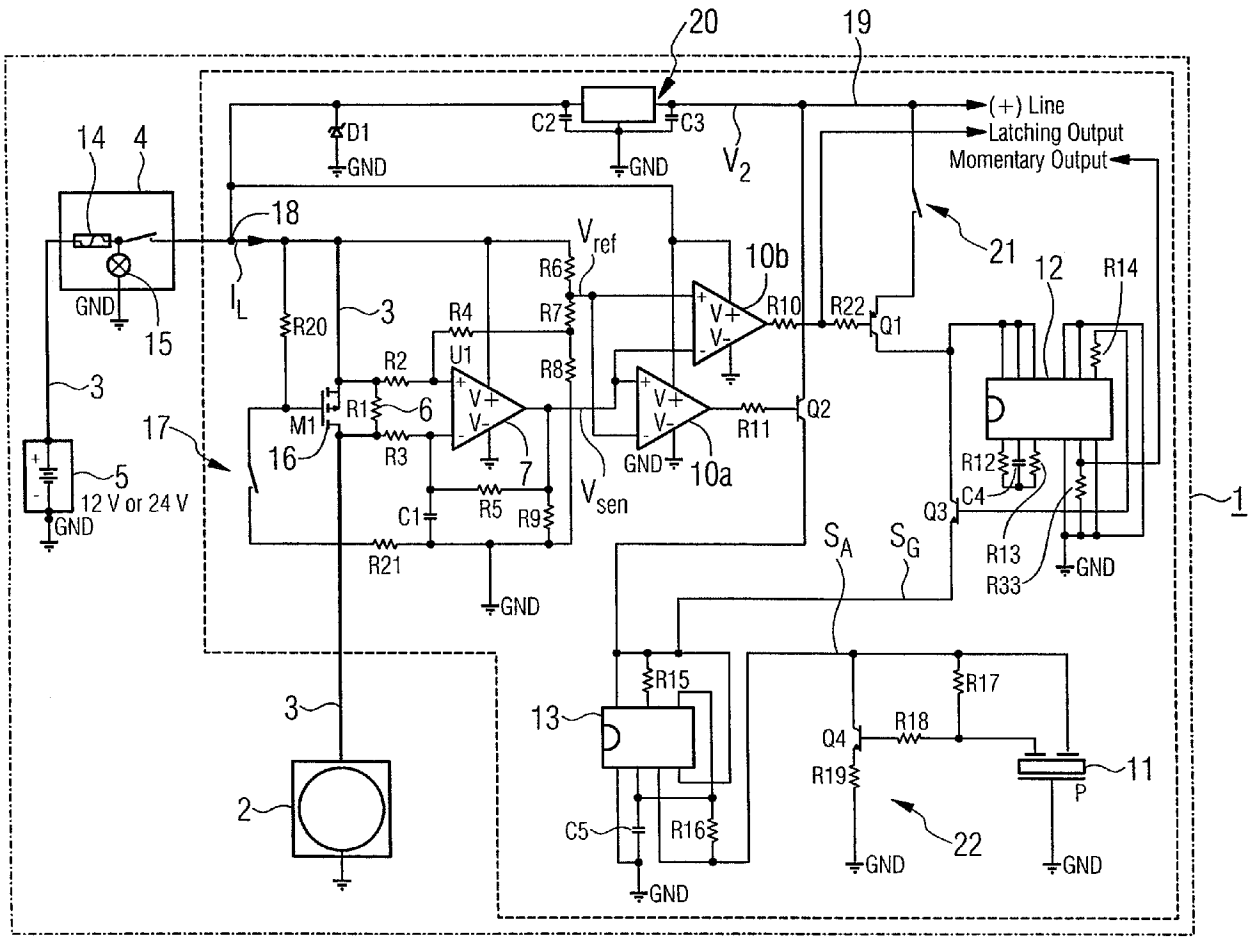
FIG. 3 is a relatively detailed wiring diagram of the device according to the invention for monitoring the electrical circuit between a battery and the safety unit, in particular a bilge blower.

If the sensor voltage $V_{sen}$ is higher than, or equal to, the reference voltage $V_{ref}$, the output side of the second comparator 10*b* will supply a control signal (high-level). According to the flow chart of FIG. 2, it is inquired by inquiry 105 whether the "left-on function", explained in detail in the following by FIG. 3, is activated. If this is the case, the timer 12 will be activated and a time function element 106 of a few minutes (min), for example 10 minutes, will be started. Upon expiration of the time function element 106, the acoustice alarm-signalling device 11—or the pulse generator 13 for its selection—will be activated and the so-called left-on alarm will be triggered.

That means that the alarm function will always be activated if the described monitoring device 1 detects an interruption of the electrical circuit 3. If, in addition, the left-on function is activated, an alarm will be triggered even if the electrical circuit 3 works perfectly and the safety unit (bilge blower) 2 connected to it has been in operation for a longer time than the set delay time, for example, longer than 10 minutes. The acoustic alarm then triggered indicates to the vehicle driver or operator that he should switch off the bilge blower 2.

FIG. 3 shows a detailed wiring diagram of the monitoring device 1. One recognizes the electrical circuit 3 to be monitored, highlighted with relatively thick lines. The safety unit to be monitored, in the form, for example, of the bilge blower 2, and the vehicle battery 5, usually supplying a battery voltage $V_1$=12 V or $V_1$=24 V, are also represented. The enabling switch 4, represented in a relatively detailed manner, contains a fuse element 14, e.g. an expansion-wire fuse, and an indicator lamp 15. The latter is connected, on the one hand, in the plotted direction of arrow of the load current $I_L$ behind the fuse element 14 to the enabling switch 4, and is connected, on the other hand, to ground. The indicator lamp 15 will illuminate in disturbance-free operation, even if the enabling switch 4 is open, as it is connected upstream of the enabling switch 4 or the latter's contacts. The fuse element 14 is wired between the enabling switch 4 or the latter's switching contacts and the vehicle battery 5.

The fuse element 14 serves, in combination with the indicator lamp 15, for monitoring the electrical circuit 3 in the area between the vehicle battery 5 and the enabling switch 4. If the electrical circuit 3 is interrupted there, for example because the fuse element 14 has responded due to an excess current (overload or short circuit), the indicator lamp 15 will go out.

Furthermore, a power semiconductor in the form of a MOSFET (metal-oxide semiconductor field-effect transistor) is wired in parallel to the shunt 6, the gate of the power semiconductor being connected via a resistor R20 to the battery 5 and to a hand switch 17. This low-high current-sense switch circuit with the hand switch 17 and with the MOSFET 16 in combination with the control resistor R20 enables a change-over between high and low load currents $I_L$.

It is evident from FIG. 3 that the operational amplifier 7 is wired, by a capacitor C1 as well as by a number of resistors R2 to R5, R8 and R9, in such a way that a current sensor with low-pass function is provided. A connector $V_+$ to a voltage tap 18 on the electrical circuit 3 as well as a connection of the connector $V_-$ to ground serve for the voltage supply of the operational amplifier 7. The voltage supply $V_+$, $V_-$ of the operational amplifier 7 is thus effected directly via the enabling switch 4 from the battery 5.

A voltage divider formed by two resistors R6 and R7, also wired to the voltage tap 18 and, therefore, directly connected via the enabling switch 4 to the battery 5, serves for generating the reference voltage $V_{ref}$ for the two comparators 10*a* and 10*b*. The voltage supply $V_+$, $V_-$ of the two comparators 10*a* and 10*b* is also effected via the enabling switch 4 directly from the battery 5, the connectors $V_+$ of the two comparators 10*a* and 10*b* being connected for that purpose to the voltage tap 18 and the connectors $V_-$ against ground.

The outputs of the two comparators 10*a* and 10*b* are connected to a gate (base) of a transistor Q1 or Q2, respectively. The emitter sides of the two transistors Q1, Q2 are connected to a supply line 19 supplying a supply voltage $V_2$. This supply voltage $V_2$ is also gained via a tap on the electrical circuit 3 behind the enabling switch 4, limited via a Zener diode D1 to 9V and stabilized by a linear controller 20 to $V_2$=9V.

A transistor Q1 is connected via a hand switch 21 to the supply voltage $V_2$. Only when the hand switch 21 is in the ON position, can the supply voltage $V_2$ reach the timer circuit 12 via the emitter collector leg of the transistor Q1. When the hand switch 21 is open, the timer circuit 12 will also be deactivated, irrespective of the signal level (high or low) applied on the output of the second comparator 10*b*. If, however, the hand switch 21 has been put into the ON position and if the output of the second comparator 10*b* supplies a control signal switching the transistor Q1 through, the supply voltage $V_2$ will be supplied to the timer circuit 12 and, thus, the time function element 106 will be started. This will be the case if the sensor voltage $V_{sen}$ supplied to the inverting input (−) of the second comparator 10*b* is higher than, or equal to, the reference voltage $V_{ref}$ supplied to the non-inverting input (+). Upon expiration of the time function element 106, the timer circuit generates a control signal $S_G$ for activating the pulse generator 13, which in turn generates a control signal $S_A$ for activating the alarm-signalling device 11, which in the exemplary embodiment is piezoelectric.

The transistor Q2 selected by the first comparator 10*a* on the base side will switch the supply voltage $V_2$ to the pulse generator 13 for activating the alarm-signalling device 11 only if the sensor voltage $V_{sen}$ on the inverting input (−) of the first comparator 10*a* is smaller than the reference voltage $V_{ref}$ supplied to the non-inverting input (+). Otherwise, the transistor Q2 will remain blocked because in that case, the electrical circuit 3 is functioning perfectly, with the enabling switch 4 in the ON position. When the hand switch 21 is open, the alarm-signalling device 11 will not be activated either after some minutes.

Thus, while the first comparator 10*a* activates the piezoelectric alarm-signalling device 11 without delay when the enabling switch 4 has been put into the ON position and the electrical circuit 3 is interrupted, the second comparator 10*b* activates the left-on functionality of the monitoring device 1 and signals to the operator that the preset maximum running time of the bilge blower 2 has been exceeded. The piezoelectric alarm-signalling device 11 is activated through a driver circuit 22 connected to the output side of the pulse generator 13.

The invention claimed is:

1. A method for monitoring a function of a safety unit connected via a manually operated switch to a voltage supply, which comprises the steps of:

measuring a current flowing through the safety unit;

triggering an acoustic alarm, if a sensor voltage derived from the current measured falls below a reference voltage; and supplying the sensor voltage to a non-inverting input and the reference voltage to an inverting input of a first comparator, the first comparator activating the acoustic alarm, if the sensor voltage is lower than the reference voltage.

2. The method according to claim 1, which further comprises supplying a sensed voltage to an operational amplifier which amplifies the sensed voltage.

3. The method according to claim 1, which further comprises triggering the acoustic alarm upon expiration of an adjusted time interval, if the sensor voltage is higher than the reference voltage.

4. The method according to claim 3, which further comprises supplying the sensor voltage to an inverting input of a second comparator and the reference voltage to a non-inverting input of the second comparator, the second comparator activating a timer circuit if the sensor voltage is higher than the reference voltage.

5. The method according to claim 1, which further comprises providing a bilge blower for a boat with a combustion engine as the safety unit.

6. A device for monitoring a function of a safety unit connected via a manually operated switch to a voltage supply, the device comprising:

means for picking up a current flowing through the safety unit; and means for generating an acoustic alarm, if an output voltage of the current sensed falls below a reference voltage, said means for generating the acoustic alarm coupled to said means for picking up the current, said means for generating the acoustic alarm having an acoustic alarm-signalling device and a comparator with a first input to which a sensor voltage derived from the current measure is supplied, a second input to which the reference voltage is supplied, and an output on which a control signal for selecting said acoustic alarm-signalling device can be tapped.

7. The device according to claim 6, wherein said means for generating the acoustic alarm has a current sensing circuit having an operational amplifier with an input side connected to said means for picking up the current flowing through the safety unit, said operational amplifier further having an output side supplying the sensor voltage derived from the current measured.

8. The device according to claim 7, wherein said operational amplifier is wired as a differential amplifier.

9. The device according to claim 6, further comprising:

a supply line for a voltage supply; and a electronic switch having a gate/base connected to said output of said comparator, said electronic switch is wired between said supply line and said acoustic alarm-signalling device.

10. The device according to claim 6, further comprising a timer circuit; and wherein said means for generating the acoustic alarm has a further comparator with a first input receiving the reference voltage, a second input receiving the sensor voltage derived from the current measured, and an output on which a control signal for selecting said timer circuit can be tapped.

11. The device according to claim 10, further comprising a supply line for a voltage supply; and further comprising an electronic switch having a gate/base connected to said output of said further comparator, said electronic switch is wired between said supply line and said acoustic alarm-signalling device.

12. The device according to claim 11, wherein said timer circuit has an output connected to said acoustic alarm-signalling device.

13. The device according to claim 11, further comprising a pulse generator, said timer circuit has an output connected to said pulse generator for selecting said acoustic alarm-signalling device.

14. The device according to claim 13, wherein:

said acoustic alarm-signalling device is an piezoelectric alarm-signalling device having a driver circuit; and said pulse generator has an output connected to said driver circuit of said piezoelectric alarm-signalling device.

15. The device according to claim 10, further comprising a hand switch for activating and deactivating said timer circuit.

16. The device according to claim 6, further comprising a circuit for a linear control of a supply voltage for said means for generating the acoustic alarm.

17. The device according to claim 6, further comprising:

an electronic power switch; and a hand switch for activating and deactivating said electronic power switch connected in parallel to said means for picking up the current flowing through the safety unit, used to preset the current sensor for heavy or light loads.

18. The device according to claim 6, wherein the safety unit is a bilge blower of a boat with a combustion engine.

19. A switching circuit for monitoring a function of a safety unit connected via an electrical circuit with a manually operated switch to a voltage supply, the switching circuit comprising:

means for picking up a current flowing through the electrical circuit;

means for generating a sensor voltage which is proportional to the current measured;

means for comparing the sensor voltage with a reference voltage;

means for generating an acoustic alarm, if the sensor voltage differs from the reference voltage, said means for generating the acoustic alarm having an acoustic alarm-signalling device; and said means for comparing the sensor voltage having a comparator with a first input to which the sensor voltage derived from the current measured is supplied, a second input to which the reference voltage is supplied, and an output on which a control signal for selecting said acoustic alarm-signalling device can be tapped.

20. The switching circuit according to claim 19, wherein the safety unit is a bilge blower of a boat with a combustion engine.

* * * * *